United States Patent [19]

Ichikawa et al.

[11] Patent Number: 4,966,025

[45] Date of Patent: Oct. 30, 1990

[54] HORIZONTALLY OPPOSED-DIE TYPE EDGING PRESS

[75] Inventors: Mitsuhiko Ichikawa; Bunpei Masuda; Nobuhiro Tazoe; Masujiro Yoshida; Kenichi Ide, all of Yokohama, Japan

[73] Assignee: Ishikawajima-Harima Jukogyo Kabushiki Kaisha, Japan

[21] Appl. No.: 410,616

[22] Filed: Sep. 21, 1989

[30] Foreign Application Priority Data

Nov. 2, 1988 [JP] Japan ..... 63-278227

[51] Int. Cl.[5] ..... B21J 7/32

[52] U.S. Cl. ..... 72/184

[58] Field of Search ..... 72/206, 184, 190; 83/318

[56] References Cited

U.S. PATENT DOCUMENTS 4,329,899 5/1982 Hori ..... 83/318

FOREIGN PATENT DOCUMENTS 222651 10/1986 Japan ..... 72/184
61-273229 12/1986 Japan .
62-68646 3/1987 Japan .

*Primary Examiner*—Lowell A. Larson

[57] ABSTRACT

Each of a pair of opposing slides which is equipped with a die and is connected through a connecting rod to an eccentric portion of a crankshaft is displaced by a width setting device in the direction of width of a slab so as to set the width of a slab to be forged between the pair of dies. After the setting of the width of a slab to be forged, the crankshaft is rotated to cause each of the slider-pair to reciprocate not only in the direction of width of the slab but also in the direction in parallel with the slab transportation line, whereby a slab is forged.

3 Claims, 6 Drawing Sheets

HORIZONTALLY OPPOSED-DIE TYPE EDGING PRESS

BACKGROUND OF THE INVENTION

The present invention relates to a horizontally opposed-die type edging press used for forging of a slab, i.e., for decreasing the width of a slab at a position upstream of a rolling line or downstream of a continuous casting line.

Conventional horizontally opposed-die type edging presses for forging a slab from a continuously moving billet through a strike of dies are for instance disclosed in Japanese Patent 1st Publication No. 68646/1987, Japanese Utility Model 1st Publication No. 15901/1987 and Japanese Patent 1st Publication No. 273229/1986. One of such presses will be described with reference to the above-mentioned Japanese Patent 1st Publication No. 68646/1987. In order to set the width of a slab to be forged, provided is a width setting device of the type in which a lead screw is threaded into a connecting rod fitted over an eccentric portion of a crankshaft such that the lead screw can be reciprocated in the direction of width of a slab; the lead screw is rotated through a worm in unison with a worm wheel; and the lead screw is detachably fitted at its one end into a slide upon which a die is detachably mounted, whereby distance between the opposing dies is set. Upon rotation of the lead screws, the slides are displaced to move the opposing dies toward or away from each other, thereby setting the width of a slab to be forged.

The edging press of the type described above has the following various problems:

(1) Since the width setting device is disposed in the connecting rod, load exerted to the connecting rod becomes excessive heavy so that a device for driving the edging press becomes large in size and acceleration energy for the press is increased.

(2) Since any motion of the eccentric portion of the crankshaft is transmitted to the slide through the connecting rod upon which the width setting device is disposed, the connecting rod receives impact load in forging of a slab and tends to vary in length, resulting in variation of load torque exerted to the crankshaft.

(3) Since the width setting device complicated in structure is disposed in the connecting rod which translates the rotation of the eccentric portion of the crankshaft into the reciprocal motion of the slide, inspection and maintenance of the width setting device become cumbersome so that the rate of operation of the edging press is lowered and consequently the shutdown time of the production line as a whole is increased. As a result, production efficiency cannot be improved.

The present invention was made to solve the above and other problems encountered in the conventional edging presses and has for its object to provide a horizontally opposed-die type edging press with a width setting device capable of operating at a high degree of efficiency and allowing easy inspection and maintenance.

To the above and other ends, a horizontally opposed-die type edging press in accordance with the present invention comprises slides each having a die, said slides being disposed to sandwich a slab transportation line, bearing boxes disposed on a side of the corresponding slide remote from said line, a crankshaft supported by said bearing boxes, a connecting rod for connecting an eccentric portion of said crankshaft with the corresponding slide, a parallel displacement mechanism for moving each of said slides in the direction in parallel with said line and a width setting device disposed on a side of said bearing boxes remote from said line adapted to causing the bearing boxes to displace in a direction of width of a slab to be forged.

The axis of the crankshaft may be in parallel with or perpendicular to the slab transportation line. Means for connecting the crankshaft with a drive may be flexible joints and gear boxes.

In forging a slab by the edging press with the above described construction, the width setting devices cause the bearing boxes to displace in the direction of width of a slab so as to set the width of the slab. Thereafter the crankshafts are rotated to cause the slides to reciprocate in the direction of width of the slab while the parallel displacement mechanisms cause the slides to reciprocate in the direction in parallel with the slab transportation line.

As a result, the dies are caused not only to reciprocate in the direction of width of the slab but also to move in parallel with the slab transportation line, whereby a slab is forged.

According to the present invention, the width setting device for setting a width of a slab to be forged is disposed at one side of the bearing boxes remote from the slab transportation line so that the slabs can be forged with no variation of the load torque which may otherwise be caused by the impact forces from the dies and the slides.

BRIEF DESCRIPTION OF THE DRAWINGS

The same reference numerals are used to designate similar parts throughout the figures.

DETAILED DESCRIPTION OF THE PREFERRED EMBODIMENTS

Figure 1:
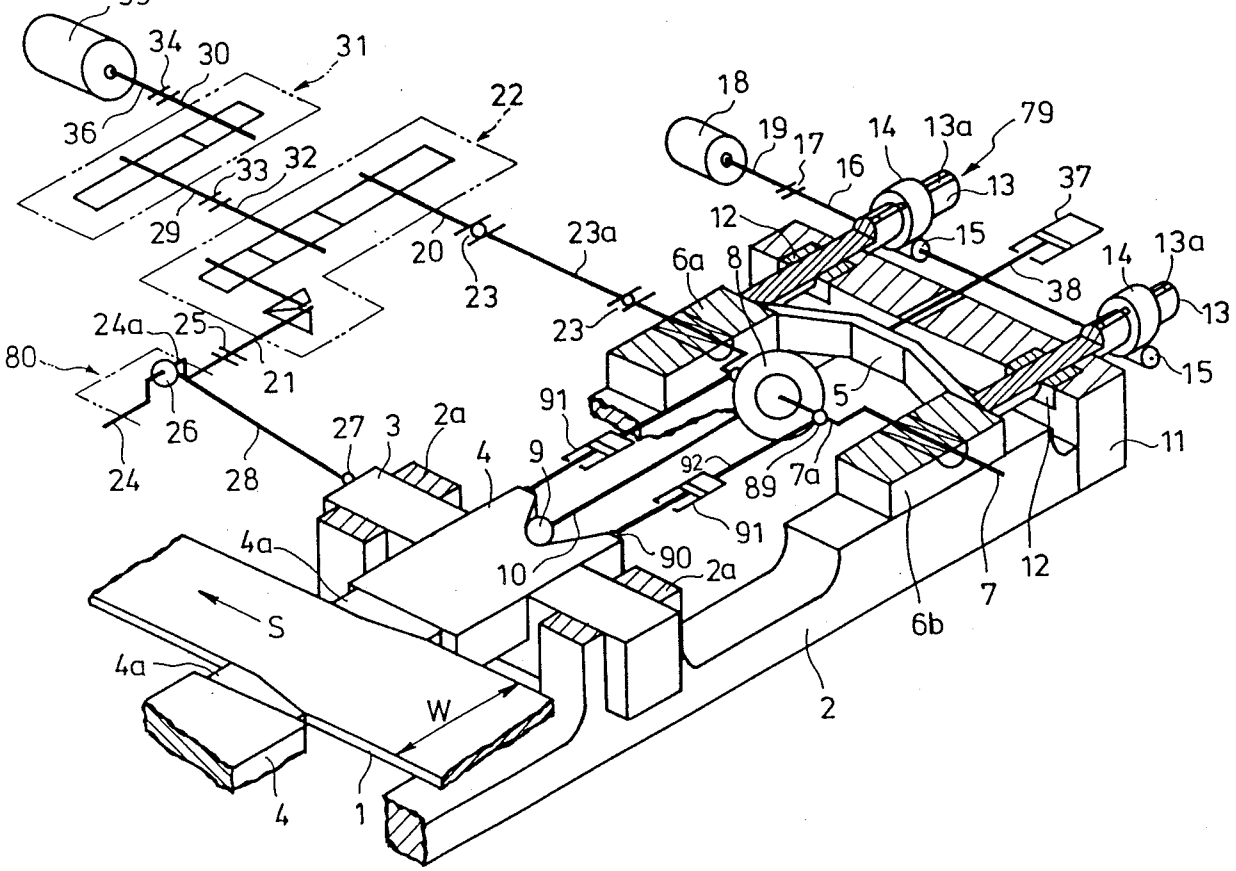
FIGS. 1 through 4 are partial sectional views of first to fourth preferred embodiments, respectively, of the present invention.

Referring first to FIG. 1, a first preferred embodiment of the present invention will be described in which frames 2 are disposed on opposite sides of a slab transportation line S to sandwich a slab 1 therebetween. A travel guide 3 is fitted in a pair of guides 2*a* extending upwardly from the frame 2 for displacement of the guide 3 in the direction in parallel with the slab transportation line S. A slide 4 is fitted over the travel guide 3 for movement of the slide 4 in the direction of width W of the slab 1. A die 4*a* for forging the slab 1 is detachably attached on the side of the slide 4 near the line S.

A frame 5 is disposed at the side of the slide 4 remote from the line S such that the frame 5 is movable in the direction of width W of the slab 1. Bearing boxes 6*a* and 6*b* mounted on the frame 5 support a crankshaft 7 extending in the direction in parallel with the line S. A spherical bearing 8 fitted over an eccentric portion 7*a* of the crankshaft 7 is connected through a connecting rod 10 to a spherical bearing 9 mounted on the side of the slide 4 remote from the line S.

Each spherical bearing 89 fitted over the eccentric portion 7a is connected to a corresponding spherical bearing 90 attached through a counterbalance cylinder 91 and a rod 92 to the slide 4.

Each nut 12 is securely fitted into a corresponding through hole which is drilled or otherwise defined through an end 11 of the frame 2 extending beyond the frame 5 away from the line S and which extends in the direction of width W of the slab 1. Each width setting threaded rod 13 has an outer periphery which partly provides an externally thread engaged with the corresponding nut 12 such that one end of the rod 13 near the line S may contact a side of the corresponding bearing box remote from the line S.

A worm wheel 14 is engaged with a spline 13a defined at the outer periphery near the other end of the rod 13 and is in mesh with a worm 15 carried by a drive shaft 16 which is connected through a shaft coupling 17 with a drive shaft 19 of a drive 18. Thus, the width setting device generally indicated by reference numeral 79 is provided.

A gear box 22 has an output shaft 20 extending in the direction in parallel with the line S as well as an output shaft 21 extending in the direction of width W of the slab 1 and is disposed downstream of the frame 2 with respect to the line S. The output shaft 20 is drivingly connected through flexible couplings 23 and intermediate shaft 23a to the crankshaft 7.

The gear box 22 supports at its side near the line S a crankshaft 24 which extends in the direction of width W of the slab 1 and which is connected through a shaft coupling 25 to the output shaft 21. A spherical bearing 26 fitted over an eccentric portion 24a of the crankshaft 24 is connected through a connecting rod 28 to a spherical bearing 27 attached to a downstream end of the travel guide 3 with respect to the line S. Thus a parallel displacement mechanism generally indicated by reference numeral 80 is provided.

A gear box 31 has an output shaft 29 as well as an input shaft 30 which extend in the direction in parallel with the line S and is disposed downstream of the gear box 22 with respect to the line S. The output shaft 29 is drivingly connected through a shaft coupling 33 to the input shaft 32 of the gear box 22 and the input shaft 30 is drivingly connected through a shaft coupling 34 to an output shaft 36 of a drive 35.

A counterbalance cylinder 37 has a piston rod 38 which is reciprocal in the direction of width W of the slab 1 and which extends through the frame end 11 to be connected to the side of the frame 5 remote from the line S.

In setting the width of a slab 1 to be forged, the drive 18 is energized to rotate the worm 15.

Then, the worm wheel 14 which is fitted over the rod 13 and is in mesh with the worm 15 causes not only the rotation of but also the movement toward or away from the line S of the rod 13.

When the rods 13 are moved toward the line S, the ends of the rods 13 near the line S contact the ends of the bearing boxes 6a and 6b, respectively, remote from the line S. The bearing boxes 6a and 6b and the frame 5 are forced to move toward the line S as the rods 13 are advanced toward the line S.

Then, the slide 4 is caused to move toward the line S through the crankshaft 7, the bearing 8, the rod 10 and the bearing 9 so that the die 4a is forced to move toward the centerline of the line S, thereby reducing the width of the slab 1.

When the rods 13 are withdrawn away from the line S, the ends of the rods 13 near the line S are moved away from the ends of the bearing boxes 6a and 6b remote from the line S.

In this case, the bearing boxes 6a and 6b and the frame 5 remain at their respective positions positioned when the rods 13 began to be withdrawn away from the line S. Since a liquid is being charged in a chamber of the cylinder 37 adjacent to the piston rod 38, the piston rod 38 retracts the bearing boxes 6a and 6b and the frame 5 away from the line S while the ends of the rods 13 near the line S contact the side surfaces of the bearing boxes 6a and 6b remote from the line S.

Retraction of the bearing boxes 6a and 6b and the frame 5 away from the line S causes the slide 4 to move away from the line S through the crankshaft 7, the spherical bearing 8, the connecting rod 10 and the spherical bearing 9 so that the die 4a is moved away from the centerline of the line S, whereby the width of a slab 1 to be forged is increased.

After the width of a slab 1 to be forged is set, a drive 35 is energized so as to forge the slab 1.

Rotation produced by the drive 35 is transmitted through the gear box 31 to the bearing box 22 which is connected to the crankshaft 7 through the flexible joints 23 and the intermediate shaft 23a so that the slide 4 is caused to reciprocate in the direction of width W of the slab 1.

Even if the frame 5 has been displaced in the direction of width W of the slab 1 due to the setting operation of the width of a slab 1 to be forged, the turning force produced by the drive 35 is transmitted to the crankshaft 7 without encountering any restriction since the output shaft 20 is connected to the crankshaft 7 through the flexible joints 23 and the intermediate shaft 23a.

Turning force produced by the drive 35 is further transmitted from the second output shaft 21 of the gear box 22 to the crankshaft 24 so that the slide 4 is caused through the travel guide 3 to reciprocate in the direction in parallel with the line S.

As a result, the die 4a reciprocates in the direction of width W of the slab while reciprocating in the direction in parallel with the line S, whereby the slab 1 is forged.

According to the first preferred embodiment, the width setting device 79 is disposed at the side of the bearing boxes 6a and 6b remote from the slab transportation line S so that in forging of a slab, the impact from the die 4a and slide 4 is not directly transmitted to the width setting device 79 so that the failure thereof hardly occurs.

Figure 2:
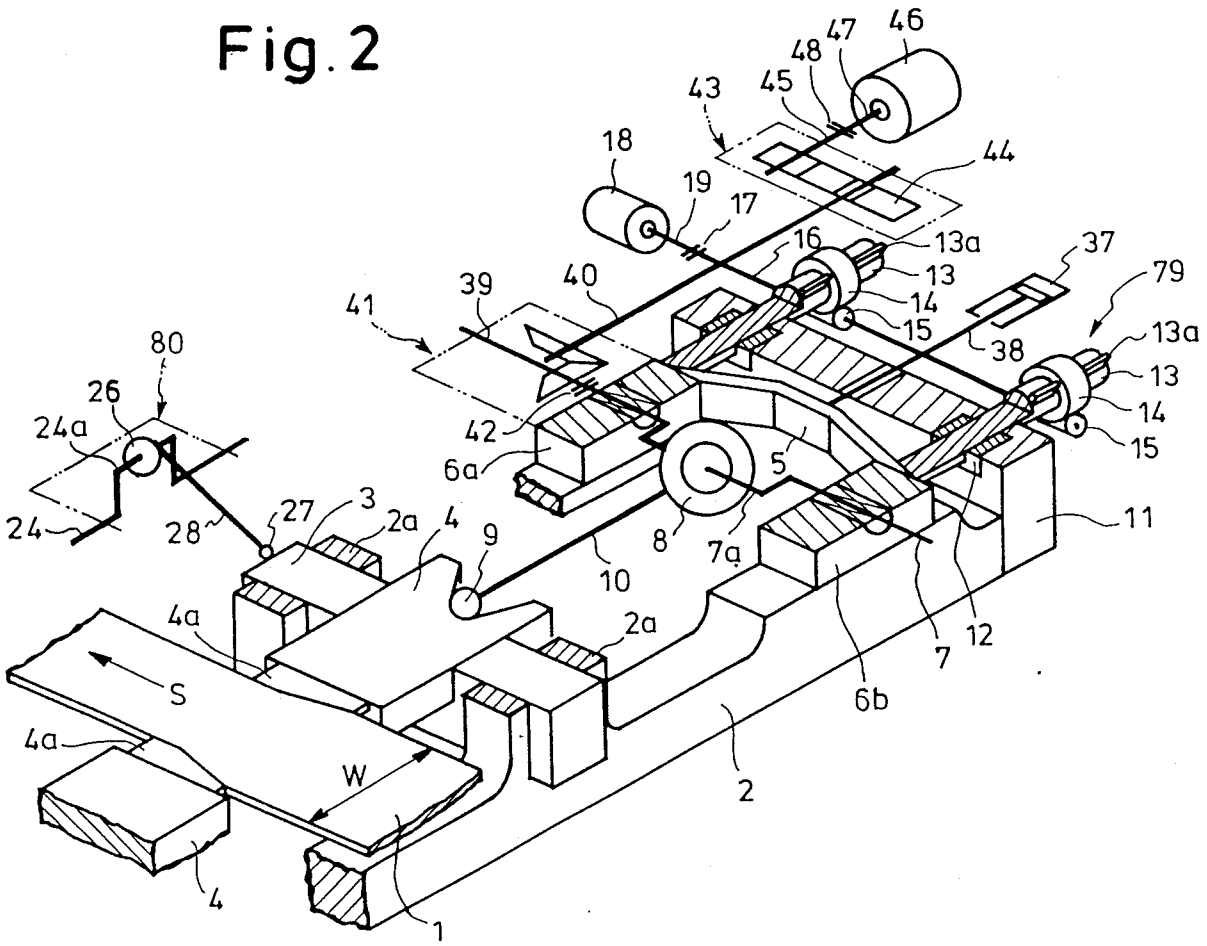

Referring next to FIG. 2, a second preferred embodiment of the present invention will be described. A gear box 41 which has an output shaft 39 extending in the direction in parallel with the line S and a splined input shaft 40 extending in the direction of width W of the slab 1 is attached to the downstream side of the bearing box 6a with respect to the line S. The output shaft 39 is connected through a shaft coupling 42 to the crankshaft 7.

A gear box 43 is disposed at the side of the gear box 41 remote from the line S and has an output gear 44 and an input shaft 45. The output gear 44 is securely fitted over the input shaft 40 of the gear box 41 and the input shaft 45 is connected through a shaft coupling 48 to an output shaft 47 of a drive 46.

In the second embodiment with the above-described construction, in setting the width of a slab 1 to be forged, the width setting threaded rods 13 are rotated so as to displace the bearing boxes 6a and 6b and the frame 5 in the direction of width W of a slab as in the case of the first embodiment. After the setting of the width of the slab, the drive 46 is energized so as to forge a slab 1.

The turning force produced by the drive 46 is transmitted through the output gear 44 to the gear box 41 from which the turning force is further transmitted through the output shaft 39 and the shaft coupling 42 to the crankshaft 7 so that the slide 4 is caused to reciprocate in the direction of width W of the slab.

Even if the frame 5 has been displaced in the direction of width W of the slab due to the setting operation of the width of a slab 1 to be forged, the turning force of the drive 46 is transmitted without any restriction since the splined input shaft 40 extending from the gear box 41 is being fitted in the output gear 44 of the gear box 43.

Turning force produced by a drive (not shown) and transmitted to the crankshaft 24 causes the slide 4 through the travel guide 3 to reciprocate in the direction in parallel with the slab transportation line S.

As a result, the die 4a reciprocates in the direction of width W of the slab while reciprocating in the direction in parallel with the line S, whereby the slab 1 is forged.

Figure 3:
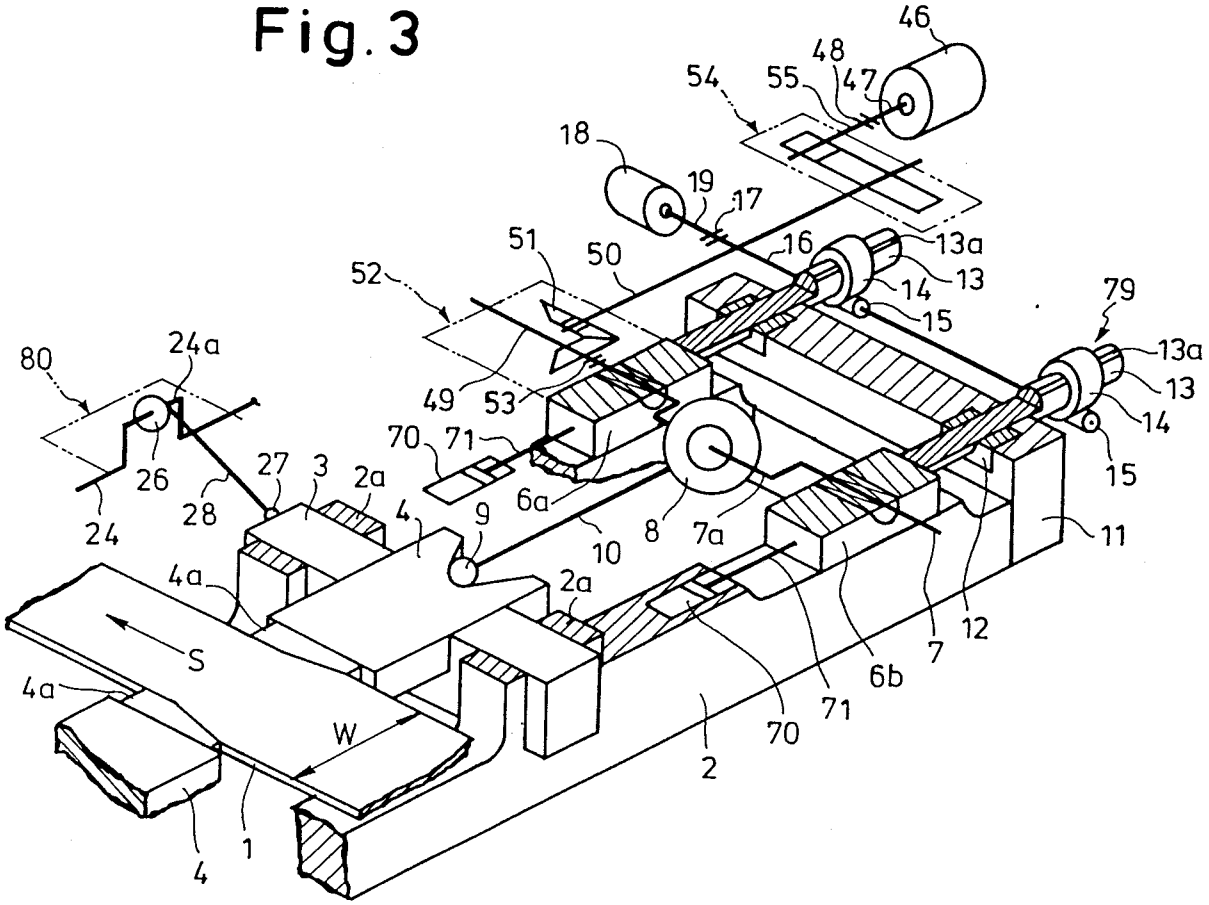

Referring next to FIG. 3, a third embodiment of the present invention will be described in which a gear box 52 is securely disposed at a position downstream of the bearing box 6b with respect to the slab transportation line S. The gear box 52 has an output shaft 49 extending in the direction in parallel with the line S as well as an input gear 51 into which a splined output shaft 50 extends in the direction of width W of the slab. The output shaft 49 is connected through the shaft coupling 53 to the crankshaft 7.

A gear box 54 having the output shaft 50 as well as an input shaft 55 is disposed at a side of the gear box 52 remote from the line S. The output shaft 50 is fitted into the input gear 51 of the gear box 52 and the input shaft 55 is connected through a shaft coupling 48 to the output shaft 47 of the drive 46. The rods 13 is in contact with the sides of the bearing boxes 6a and 6b, respectively, remote from the line S. Piston rods 71 of counterbalance cylinders 70 are in contact with the sides of the bearing boxes 6a and 6b near the line S.

According to the third embodiment with the above described construction, in setting the width of a slab to be forged, the width setting threaded rods 13 are rotated as in the case of the first embodiment to displace the bearing boxes 6a and 6b in the direction of width W of the slab and, if necessary, the counter balance cylinders 70 are energized to set the width of a slab 1 to be forged. Thereafter the drive 46 is energized, thereby forging a slab 1.

The turning force produced by the drive 46 is transmitted through the gear box 54 to the bear box 52 from which the turning force is transmitted through the output shaft 49 and the shaft coupling 53 to the crankshaft 7. Therefore the slide 4 is caused to reciprocate in the direction of width W of the slab.

Even if the bearing boxes 6a and 6b have been displaced in the direction of width W of the slab, the turning force is transmitted from the drive 46 to the crankshaft 7 without any restriction since the splined output shaft 50 of the gear box 54 is in engagement with the input gear 51 of the gear box 52.

Turning force from a drive (not shown) transmitted to the crankshaft 24 causes the slide 4 to reciprocate through the travel guide 3 in the direction in parallel with the line S. Thus the dies 4a reciprocate in the direction of width W while reciprocating also in the direction in parallel with the line S, whereby a slab 1 is forged.

Figure 4:
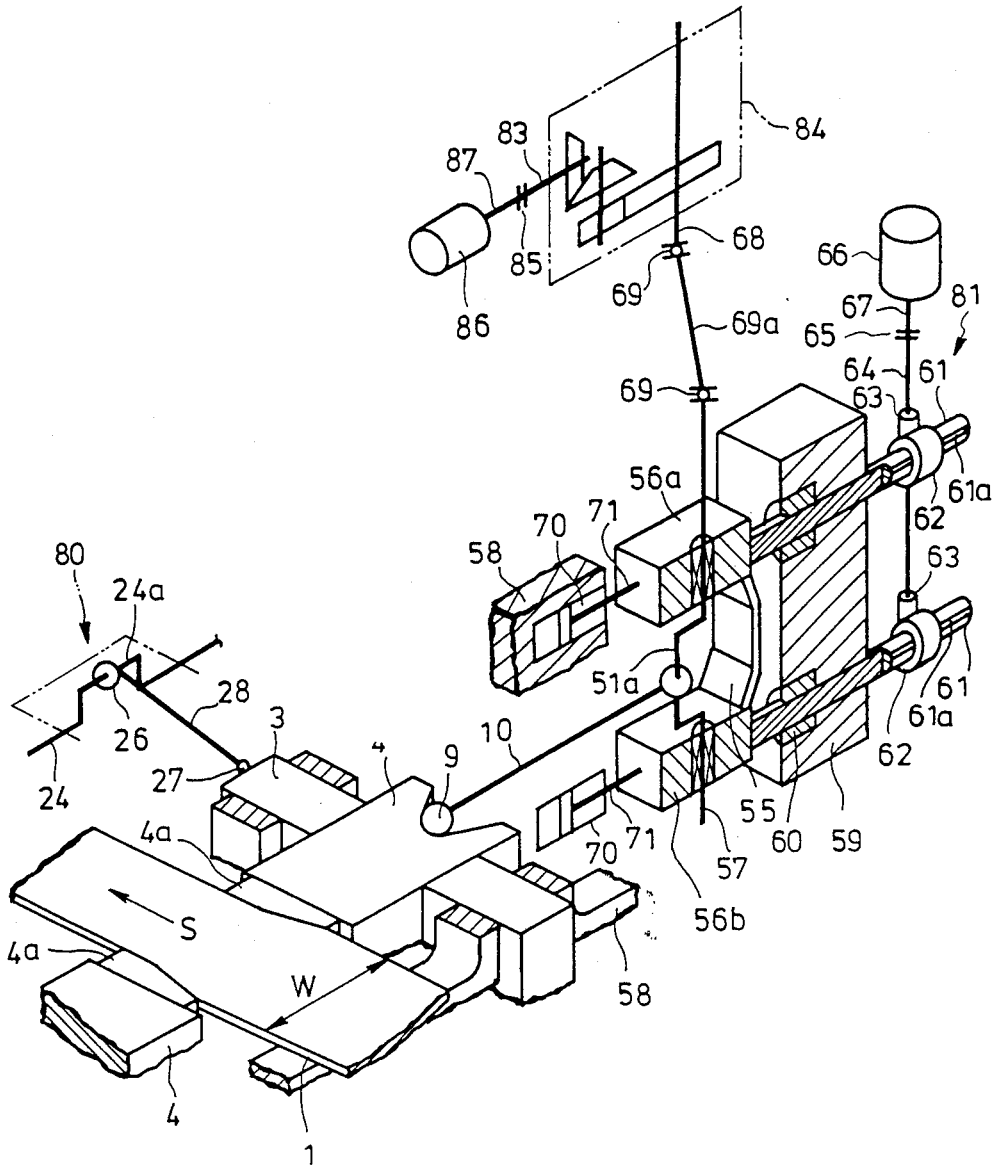
Figure 5:
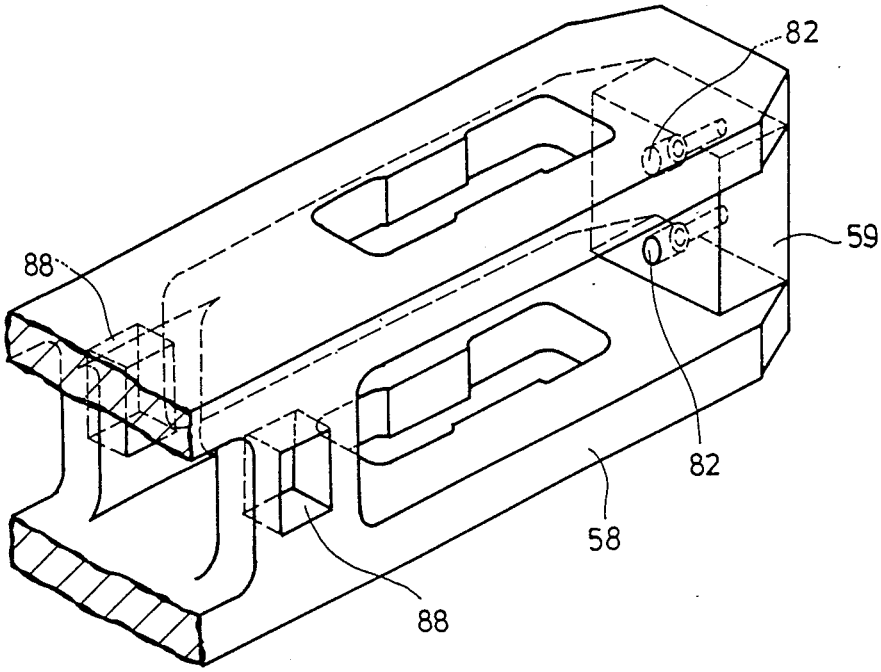
FIG. 5 is a partial sectional view of a frame in the fourth embodiment shown in FIG. 4.

Referring next to FIGS. 4 and 5, a fourth preferred embodiment of the present invention will be described in which a frame 55 is disposed at the side of a slide 4 remote from the slab transportation line S such that the frame 55 is movable in the direction of width W of the slab. A crankshaft 57 is vertically supported by bearing boxes 56a and 56b mounted on the frame 55 and an eccentric portion 57a of the crankshaft 57 is connected through the connecting rod 10 with a spherical bearing 9 attached at the side surface of the slide 4 remote from the line S.

Nuts 60 are securely fitted into through holes 82 extending in the direction of width W of the slab through an end portion 59 of the frame 58 which in turn extends in the direction away from the line S. The nuts 60 are in mesh with the externally threaded screws of width setting threaded rods 61 extending in the direction of width W of the slab so that the ends of the rods 61 near the line S are in opposed relationship with the side surfaces of the bearing boxes 56a and 56b remote from the line S.

A worm wheel 62 is fitted over a splined end portion 61a of each of the rods 61 and is in mesh with a worm 63 carried by a drive shaft 64 which is connected through a shaft coupling 65 to an output shaft 67 of a drive 66. Thus, a width setting device generally indicated by reference numeral 81 is provided.

A gear box 84 is disposed above the bearing box 56a and has an upwardly extending output shaft 68 and an input shaft 83 extending in the direction of width W of the slab. The output shaft 68 is connected through flexible joints 69 and an intermediate shaft 69a to the crankshaft 57 and the input shaft 83 is connected through a shaft coupling 85 to an output shaft 87 of a drive 86.

Counterbalance cylinders 70 are disposed in the frame 58 and have fowardly and backwardly movable piston rods 71 which are in contact with the side surfaces of the bearing boxes 56a and 56b near the line S.

FIG. 5 is a partly cut-away perspective view of the frame 58 which has windows or openings 88 into which in turn the travel guide 3 is slidably inserted such that the travel guide 3 can be moved in the direction in parallel with the line S.

In setting the width of a slab 1 to be forged, the drive 66 is energized to rotate the worm 63.

Upon rotation of the worm 63, the worm wheel 62 engaged with the spline 61a of each of the rods 61 is rotated to move each rod 61 toward or away from the line S.

When the rods 61 are moved toward the line S, the ends of the rods 61 near the line S are made in contact with the side of the bearing boxes 56a and 56b remote from the line S and the bearing boxes 56a and 56b and the frame 55 are pushed toward the line S as the rods 61 are advanced.

Pushed movement of the bearing boxes 56a and 56b and the frame 55 toward the line S causes the slide 4 to move toward the line S through the crankshaft 57, the connecting rod 10 and the spherical bearing 9. As a result, the die 4a is forced to move toward the centerline of the line S, thereby narrowly setting the width of a slab to be forged.

On the other hand, when the rods 61 are moved away from the line S, the ends of the rods 61 near the line S are moved away from the side of the bearing boxes 56a and 56b remote from the line S.

In this case, the bearing boxes 56a and 56b and the frame 55 remain at their respective positions positioned when the ends of the rods 61 near the line S started to be withdrawn away from the line S. Since a liquid is being charged in the chamber of each of the counterbalance cylinders 70 adjacent to the piston rods 71, the piston rods 71 cause the bearing boxes 56a and 56b and the frame 55 to move away from the line S until the ends of the bearing boxes 56a and 56b remote from the line S contact the ends of the rods 61 near the line S.

Retraction of the bearing boxes 56a and 56b and the frame 55 away from the line S causes the slide 4 to move away from the line S through the crankshaft 57, the connecting rod 10 and the spherical bearing 9 so that the die 4a is moved away from the centerline of the line S, thereby widely setting the width of a slab 1 to be forged.

After the setting of the width of a slab to be forged, the drive 86 is energized to forge a slab 1.

The turning force produced by the drive 86 is transmitted from the gear box 84 through the flexible joints 69 and the intermediate shaft 69a to the crankshaft 57 so that the slide 4 is caused to reciprocate in the direction of width W of the slab.

Even when the bearing boxes 56a and 56b have been displaced in the direction of width W of the slab due to the setting operation of the width of a slab 1 to be forged, the turning force produced by the drive 86 is transmitted to the crankshaft 57 without any restriction since the output shaft 68 is connected to the crankshaft 57 through the flexible joints 69 and the intermediate shaft 69a.

Turning force produced by a drive (not shown) and transmitted to the crankshaft 24 causes the slide 4 to reciprocate through the travel guide 3 in the direction in parallel with the line S.

As a result, the die 4a reciprocates not only in the direction of width W of the slab but also in the direction in parallel with the line S.

In the fourth embodiment, the width setting device 81 is disposed at the side of the bearing boxes 56a and 56b remote from the line S so that in forging of slabs 1, no impact from the die 4a and slide 4 is directly exerted to the width setting device 81. As a result, breakdown of the device 81 rarely occurs.

Figure 7:
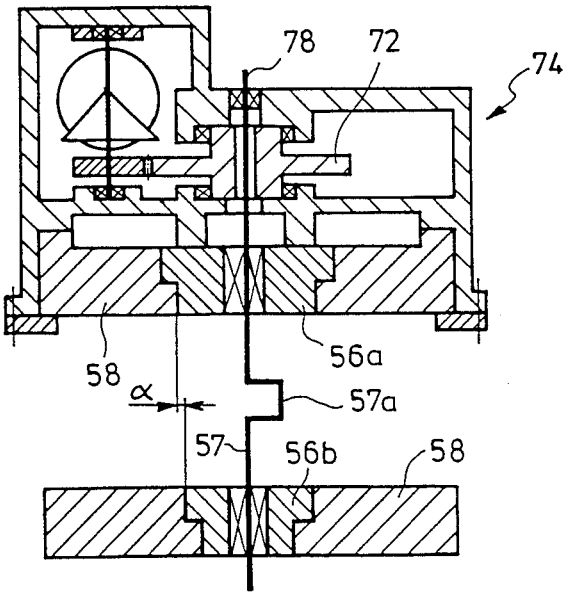
FIG. 7 is a sectional view of a gear box of the fifth embodiment shown in FIG. 6.
Figure 6:
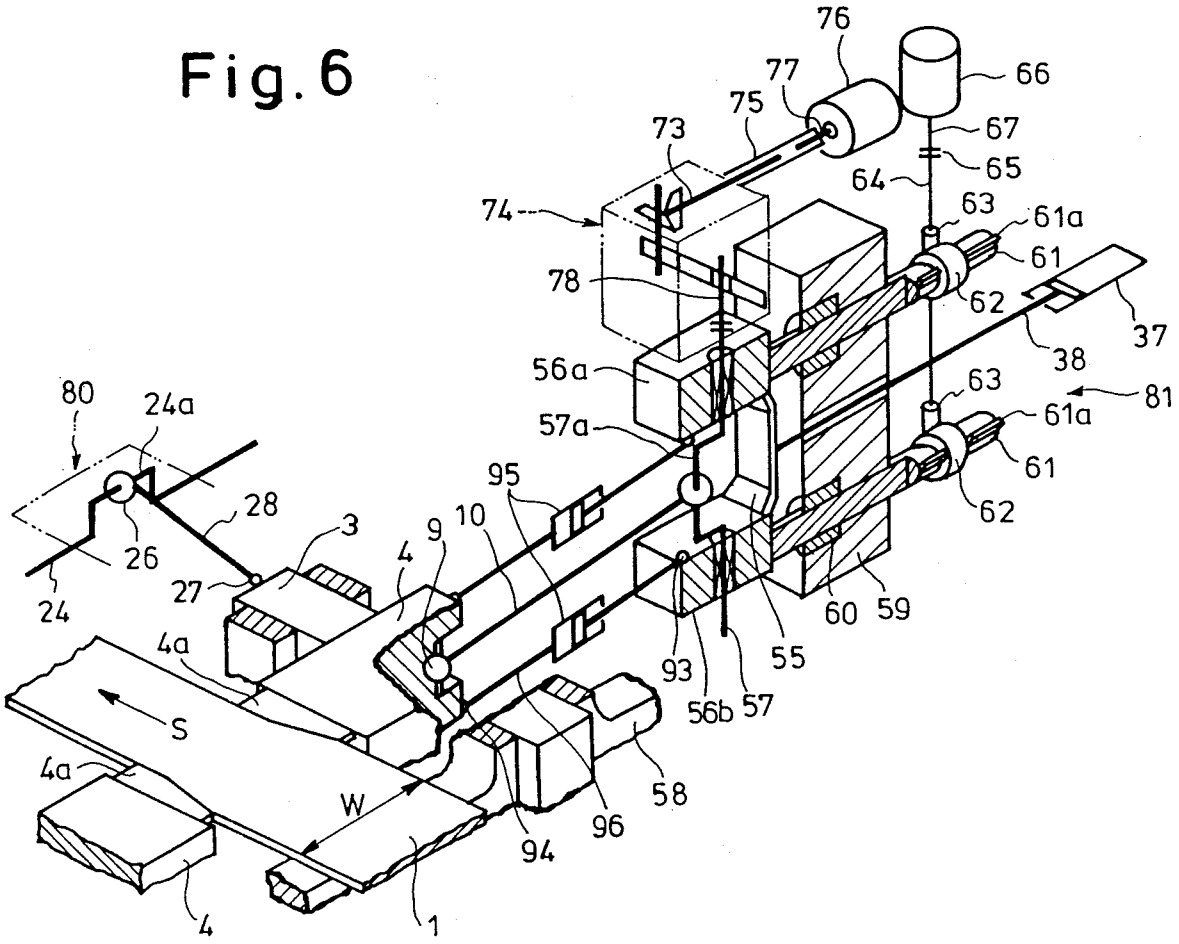
FIG. 6 is a partial sectional view of a fifth preferred embodiment of the present invention.

FIGS. 6 and 7 illustrate a fifth embodiment of the present invention in which a gear box 74 is disposed above a frame 58 and has an output gear 72 into which a vertically extending splined shaft 78 is fitted and an input shaft 73 extending in the direction of width W of the slab such that the gear box 74 can be moved in the direction of width W of the slab. The gear box 74 has an input shaft 73 which is connected through an expansion joint 75 to an output shaft 77 of a drive 76 and the splined upper end portion 78 of a crankshaft 57 is securely fitted into the output gear 72.

The bearing box 74 is driven by a drive (not shown) at the same speeds of the rods 61 in the same direction of displacement of the frame 55. In order to facilitate assembling and disassembling of the device, the both side surfaces of the gear box 56b are shortened by $\alpha$ as compared with the gear box 56a (See FIG. 7).

A fowardly and backwardly movable piston rod 38 of a counterbalance cylinder 37 extending in the direction of width W of a slab 1 extends through the frame end portion 59 and is connected to the side remote from the line S of the frame 55 having the bearing boxes 56a and 56b.

A spherical bearing 93 fitted over each of the bearing boxes 56a and 56b is connected thorough a counterbalance cylinder 95 and a rod 96 to a spherical bearing 94 attached to the slide 4.

In setting the width of a slab to be forged, as in the case of the fourth embodiment, the width setting threaded rods 61 are rotated to displace the frame 55 in the direction of width W of the slab. After the setting of the width of a slab 1 to be forged, the drive 76 is energized so as to forge a slab 1.

The turning force of the drive 76 is transmitted through the expansion joint 75 to the gear box 74 and the further transmitted through the output shaft 72 and the splined portion 78 to the crankshaft 57 so that the slide 4 is caused to reciprocate in the direction of width W of the slab.

Even if the bearing boxes 56a and 56b have been displaced in the direction of width W of the slab, the turning force produced by the drive 76 is transmitted to the crankshaft 57 without any restriction since the output shaft 77 of the drive 76 is connected through the expansion joint 75 to the input shaft 73 of the gear box 74.

Turning force produced by a drive (not shown) and transmitted to the crankshaft 24 causes the slide 4 to reciprocate through the travel guide 3 in the direction in parallel with the line S.

As a result, the die 4a reciprocates not only the direction of width W of the slab but also in the direction in parallel with the line S, whereby a slab 1 is forged.

It is to be understood that the present invention is not limited to the above-described embodiments and that various modifications may be effected without leaving the true spirit of the present invention.

As described above, the horizontally opposed-die type edging presses in accordance with the present invention can attain the following effects:

(1) The width setting device is disposed on the side of the crankshaft-supporting frame remote from the slab transportation line, so that the inspection and maintenance of the width setting device is facilitated and with less shutdown time of the whole production line, ensuring a high degree of productivity.

(2) No impact is directly exerted from the dies and slides to the width setting devices so that there is no fear of moving component parts of the width setting device being damaged which may otherwise result in the breakdown of the width setting device.

(3) The width setting device is not disposed within the connecting rod so that the rod can be made light in weight and the drives can be made in compact in size.

What is claimed is:

1. A horizontally opposed-die type edging press comprising slides each having a die, said slides being disposed to sandwich a slab transportation line, bearing boxes disposed on a side of the corresponding slide remote from said line and adapted to move in a direction of width of a slab to be forged, a crankshaft supported by said bearing boxes, a connecting rod for connecting an eccentric portion of said crankshaft with the corresponding slide, a parallel displacement mechanism for moving each of said slides in the direction in parallel with said line, a width setting device disposed on a side of said bearing boxes remote from said line and adapted to cause the bearing boxes to displace in the direction of width of the slab to be forged, means for pressing said bearing boxes to said width setting device, and a gear box on an extension of said crankshaft and adapted to be displaced by said width setting device in accordance in speed and direction with the displacement of said bearing boxes and a member for guiding the displacement of said gear box.

2. The press according to claim 1 wherein said crankshaft is supported in parallel with said line.

3. The press according to claim 1 wherein said crankshaft is vertically supported.

* * * * *